US007487726B2

(12) United States Patent
Montefusco

(10) Patent No.: US 7,487,726 B2
(45) Date of Patent: Feb. 10, 2009

(54) FIREBALL GENERATOR

(76) Inventor: Vincent Montefusco, P.O. Box 387, Mammoth Lakes, CA (US) 93546

( * ) Notice: Subject to any disclaimer, the term of this patent is extended or adjusted under 35 U.S.C. 154(b) by 0 days.

(21) Appl. No.: 11/710,353

(22) Filed: Feb. 26, 2007

(65) Prior Publication Data

US 2008/0202371 A1 Aug. 28, 2008

(51) Int. Cl.
*F42B 12/46* (2006.01)

(52) U.S. Cl. ..... 102/370; 102/363; 102/364; 431/269

(58) Field of Classification Search ..... 102/367, 102/368, 369, 370, 363, 364, 365, 335, 355; 431/267, 269, 270
See application file for complete search history.

(56) References Cited

U.S. PATENT DOCUMENTS

| | | | | |
|---|---|---|---|---|
| 3,188,954 | A * | 6/1965 | Roach et al. | 102/369 |
| 4,195,572 | A * | 4/1980 | Knapp | 102/367 |
| 4,690,061 | A * | 9/1987 | Armer et al. | 102/401 |
| 5,069,134 | A * | 12/1991 | Pinkney | 102/368 |
| 5,511,978 | A * | 4/1996 | Sellers et al. | 434/11 |
| 6,047,644 | A * | 4/2000 | Malecki et al. | 402/367 |
| 6,250,226 | B1 * | 6/2001 | Leichter et al. | 102/370 |
| 6,349,650 | B1 * | 2/2002 | Brunn et al. | 102/368 |
| 6,412,416 | B1 * | 7/2002 | Rouse et al. | 102/336 |
| 6,553,912 | B2 * | 4/2003 | Wygant | 102/498 |
| 7,261,041 | B2 * | 8/2007 | Brock | 102/498 |
| 7,389,825 | B2 * | 6/2008 | Gross et al. | 169/30 |
| 7,412,929 | B2 * | 8/2008 | Walsh | 102/368 |
| 2006/0081147 | A1 * | 4/2006 | Walsh | 102/368 |
| 2006/0166171 | A1 * | 7/2006 | Preston et al. | 434/16 |
| 2006/0233050 | A1 * | 10/2006 | Unsworth et al. | 367/144 |
| 2007/0031770 | A1 * | 2/2007 | Montefusco | 431/259 |

FOREIGN PATENT DOCUMENTS

| | | | |
|---|---|---|---|
| FR | 2598215 | A1 * | 11/1987 |
| FR | 2642160 | A3 * | 7/1990 |
| FR | 2709541 | A1 * | 3/1995 |

* cited by examiner

*Primary Examiner*—James S Bergin
(74) *Attorney, Agent, or Firm*—Irving Keschner

(57) ABSTRACT

A fireball generator device comprising a steel cylindrical main housing having first and second threaded end caps. A shotgun shell is encased in a barrel member and locked in place with a screw-on housing. When the shell is fired, the gases expelled by the shell push a knife blade forward into a gas container positioned within the main housing. The moving knife blade ruptures the gas container and the gas therein escapes and the powder gas from the shotgun shell ignites the gas escaping from the container creating various visual effects, such as a fireball.

7 Claims, 3 Drawing Sheets

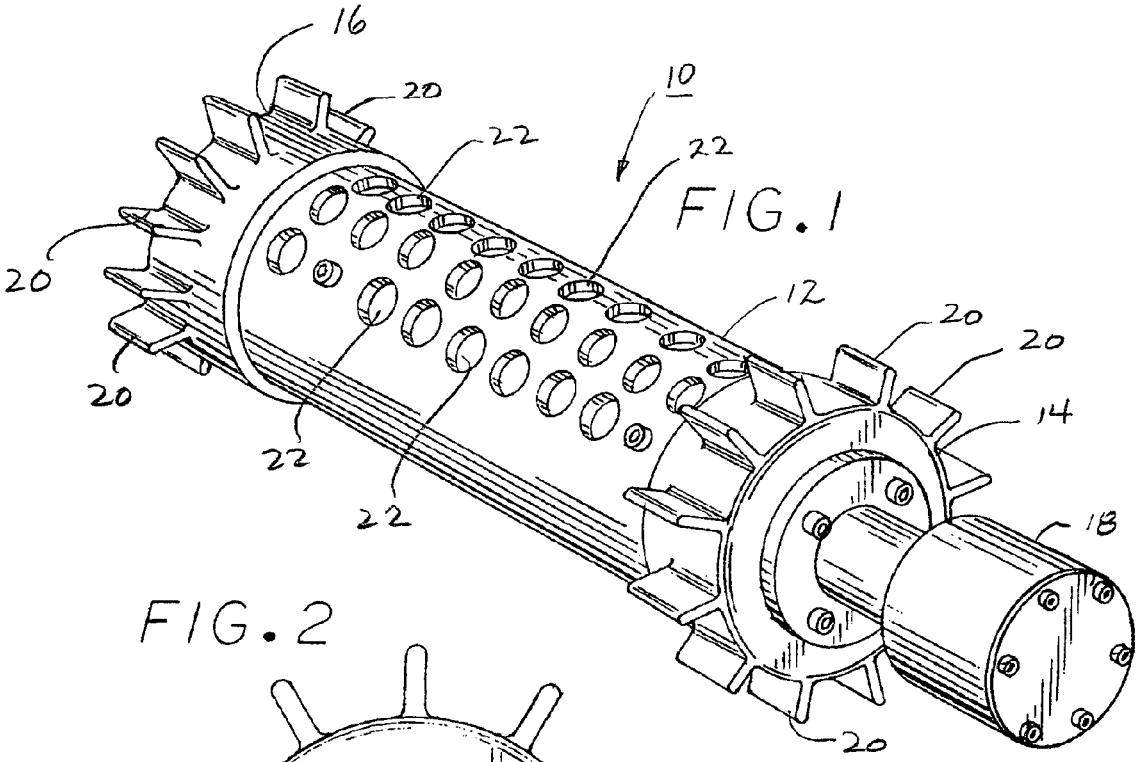
FIG. 1
FIG. 2
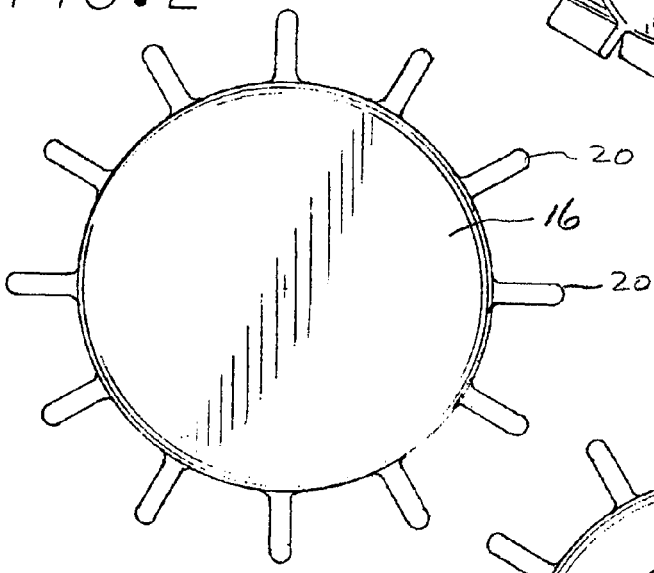
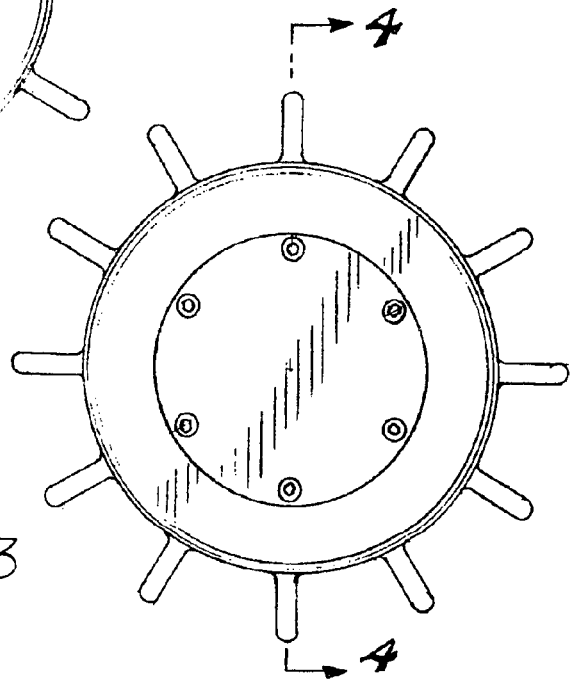
FIG. 3

FIREBALL GENERATOR

BACKGROUND OF THE INVENTION

1. Field of the Invention

A reusable device for producing a safe and consistent sized gas fireball effect for various non-destructive device uses.

2. Description of the Prior Art

Devices for producing fireballs have been available in the prior art. The typical prior art device comprises black powder contained in a carboard cup, capped and wrapped tightly with tape and placed on a fuel source such as gasoline, in a non-metal container.

The prior art fireball generators have at least one important limitation; once ignited, the device can not be reused.

Co-pending application Ser. No. 11/199,861 of common inventorship discloses a reuseable special effects audible and visual fireball generator device which comprises a cylindrical main housing having end caps mounted at each end. A gas container is positioned within the housing and a knife blade is mounted within the housing adjacent one end cap. A holder containing a predetermined amount of black sporting powder is secured within the housing adjacent the other end cap. When the black sporting powder is ignited, the gas container is forced against the knife blade, rupturing the tank. The released liquid gas mixes with air and the black sporting powder igniting the mixture and providing a fireball effect.

Although the device disclosed in the '861 application performs very well, it would be desireable if a device could produce the same visual effects without the use of black powder and an electric ignitor.

SUMMARY OF THE INVENTION

A fireball generator device comprising a steel cylindrical main housing having first and second threaded end caps. A shotgun shell is encased in a barrel member and locked in a place onto one of the end caps with a screw-on housing. When the shell is fired, the gases expelled by the shell push a knife blade member mounted adjacent the shell forward into a gas container positioned within the main housing. The moving knife blade ruptures the gas container and the gas therein escapes, the gases from the shotgun shell igniting the gas escaping from the gas container creating various visual effects, such as a fireball.

To reuse, the user opens the second end cap, replaces the tank and then unscrews the barrel and replaces the shotgun shell and starts the process over again. The first and second end caps and cylindrical housing, both preferably fabricated from steel, are cold to the touch immediately after the fireball due to the liquid gas being expelled from the vented holder. Since the fireball lasts between 1 and 3 seconds, the steel end caps and cylindrical housing remain relatively cool and thus are not heat damaged, allowing these components to be reused.

DESCRIPTION OF THE DRAWINGS

For a better understanding of the present invention as well as other objects and further features thereof, reference is made to the following description which is to be read in conjunction with the accompanying drawing therein:

FIG. 1 is a perspective view of the fireball generator device of the present invention;

FIG. 2 is a plan view of the left end of the device shown in FIG. 1;

FIG. 3 is a plan view of the right end of the device shown in FIG. 1;

DESCRIPTION OF THE INVENTION

Figure 4:
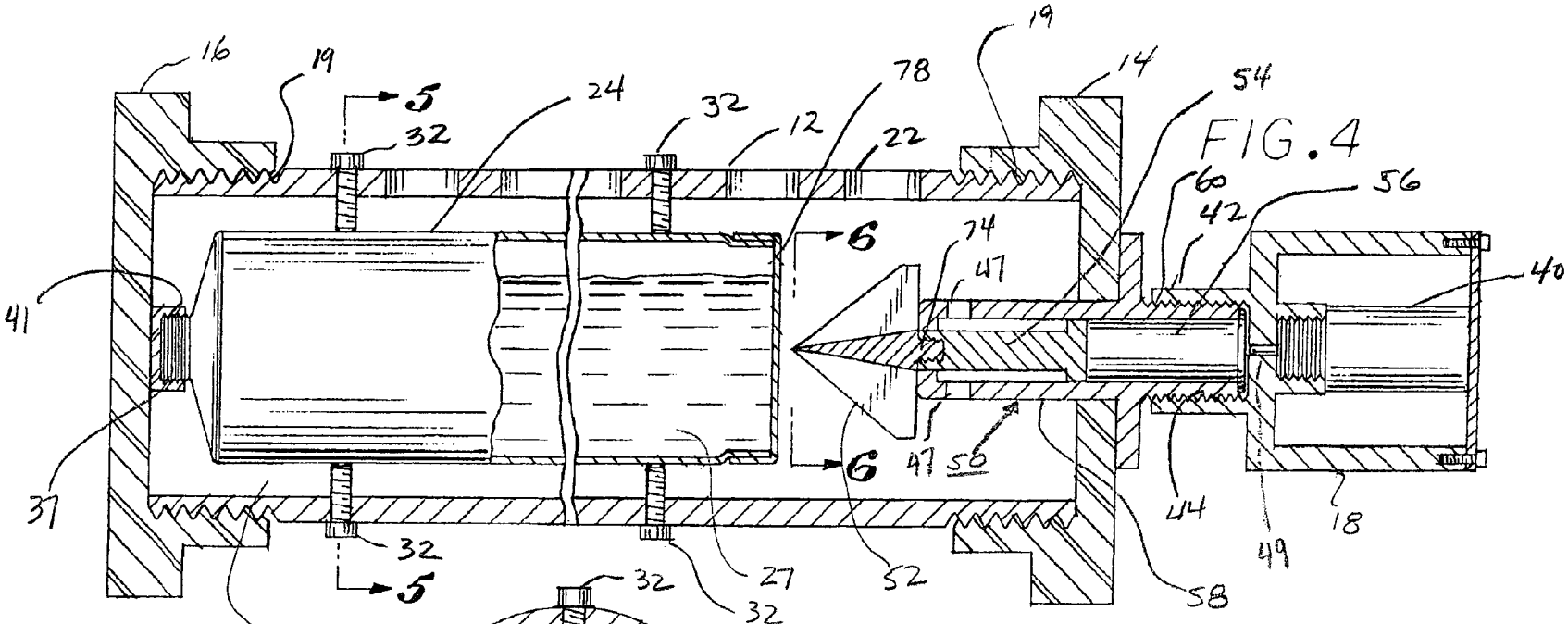
FIG. 4 is a cross-sectional view along line 4-4 of FIG. 3.
Figure 5:
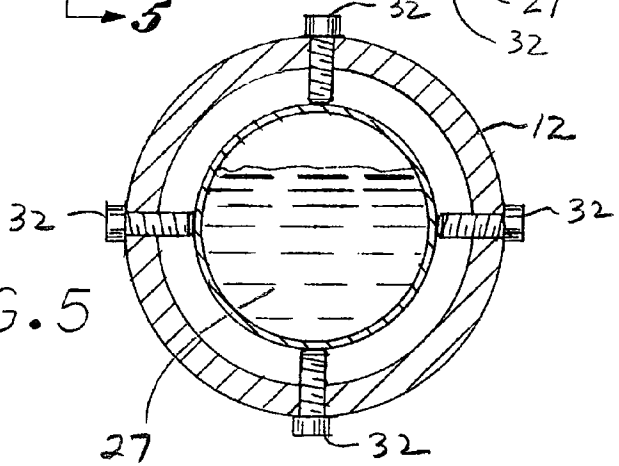
FIG. 5 is a cross-sectional view along line 5-5 of FIG. 4.

Referring now to the FIG. 1, the fireball generator device 10 of the present invention is illustrated. Fireball generator 10 comprises main housing cylinder 12, preferably made of steel, and threaded end caps 14 and 16 also preferably made of steel. End cap 14 includes holes to enable electro-mechanical solenoid housing 18 to be mounted thereto. End caps 14 and 16 screw onto threads 19 formed on the ends of housing 12 as illustrated in FIG. 4. End caps 14 and 16 have a plurality of rib members 20 extending in a radial direction from the surface of the end caps, the rib members providing better gripping and turning features for a user and preventing device 10 from rolling around on the ground after device positioning. A plurality of venting holes 22 are formed around a portion of the circumference of housing cylinder 12. As shown in FIG. 4, a liquid propane (LP) tank 24 (or a same sized tank having an equivalent ignitable type gas, such as MAPP gas) having liquid propane gas 27 therein is positioned with the hollow interior area 28 of housing 12. Four guide screws 32 (FIG. 5) equispaced around the circumference of housing 12 secure and align tank 24 in place within interior area 28.

Referring to FIG. 4, an electro-mechanical solenoid firing pin 40 is positioned within solenoid housing 18 as illustrated. Housing 18 has an elongated portion 42 having an internal thread 44 formed on its inner surface. A knife blade assembly 50 comprises replaceable knife blade 52, piston rod 54, shotgun flank shell 56 and shotgun shell barrel and piston rod cylinder 58. The end of cylinder 58 opposite knife blade 52 has an external thread 60 which is threadly engageable with thread 44. Knife blade 52 screws into piston rod 54 as illustrated.

As noted hereinabove, elongated portion 42 of solenoid housing 18 screws into the barrel shotgun shell 56, securing the shotgun shell and keeping firing pin 49 at the correct distance from the prima cap of shell 56. When the solenoid is activated, firing pin 49 hits the prima cap. Is should be noted that the commercially available solenoid has been modified to the extent that the solenoid rod acts as the firing pin 49 for the shotgun shell 56. The firing pin 49 is activated using a capacitor discharge electronic system which has sufficient voltage (typically larger than 200 VDC) to push firing pin 49 forward with sufficient force and speed to cause shotgun shell 56 to fire. A solenoid manufactured by McMaster-Carr, Atlanta, Ga., Model No. 70155K11, with the piston modified with a bull nose to function as firing pin 49 has been successfully utilized.

Figure 6:
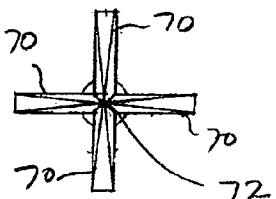
FIG. 6 is a front plan view of the knife blade taken along line 6-6 of FIG. 4.

FIG. 6 is a front view of the knife blade 52 and comprises four fin like members 70 which converge to a central area 72. Knife blade 52 includes a threaded shaft portion 74 (FIGS. 4 and 7) which, as noted above, screws into piston rod 56.

Figure 7:
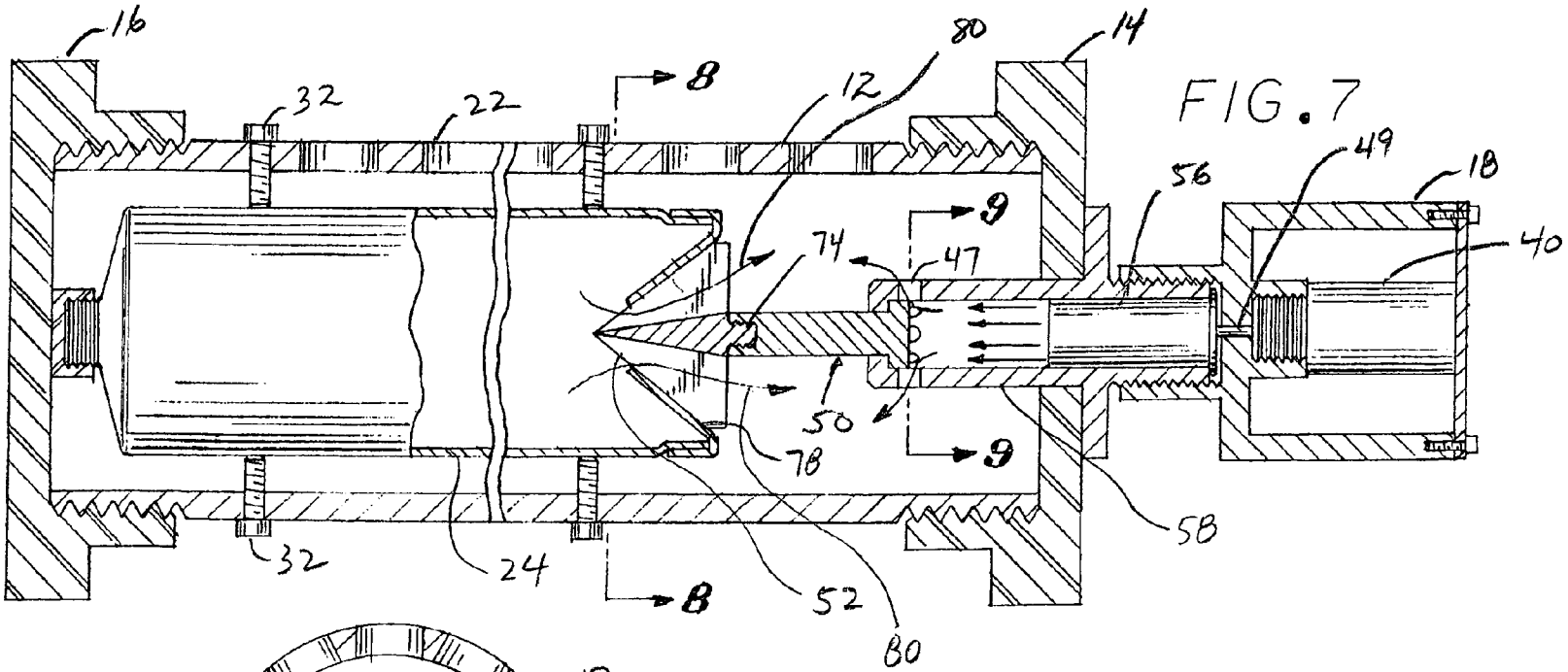
FIG. 7 is similar to the view shown in FIG. 4 showing the shot gun shell fired and the knife blade rupturing the gas cylinder.
Figure 9:
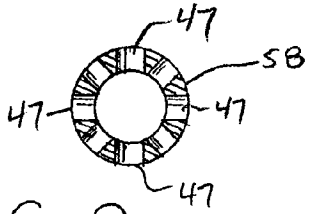
FIG. 9 is a view along line 9-9 of FIG. 7.
Figure 8:
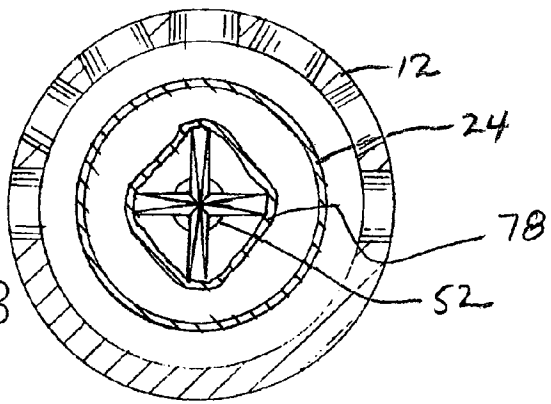
FIG. 8 is a cross-sectional view along line 8-8 of FIG. 7.

FIG. 7 is similar to FIG. 4 and shows knife blade assembly 50 after firing pin 49 has been activated such that shotgun shell 56 has been fired. Rod 54 is then propelled forward which in turn forces knife blade 52 into side 78 of container 24, rupturing the side and allowing liquid propane 27 contained therein to escape into interior 28 of housing 12 wherein it turns into a gas 80. Gas 80 fills the entire interior of housing 12 and mixes with the powder gas escaping from ports 47 formed in cylinder 58, the resultant gas mix igniting and forming a fireball.

The electro-mechanical solenoid pin 49 is activated using a high voltage pulse provided, for example, by a hand-held blasting machine used for igniting electric blasting caps.

Starting with the housing cylinder 12 and end caps 14 and 16, in order to fabricate the fireball generator of the present invention, a user unscrews the steel pipe main housing end cap 16 and then inserts tank 24 into the main housing 12. Tank 24 is positioned such that threaded boss 37 on the end of tank 24 screws into the threaded well 41 formed on the interior surface of end cap 16 to secure the tank in place. Device 10 is then moved to a predetermined area and when all conditions are safe, the shotgun shell 56 is fired by an electro-mechanical solenoid firing pin. As noted hereinabove, the electro-mechanical firing pin 49 is activated using a high voltage pulse similar to a heart defibrillator or a hand-held blasting machine used for igniting electric blasting caps.

The solenoid is screwed into a protective housing, the housing in turn screwing into the knife-blade assembly locking the shotgun shell in place. When the solenoid is energized, the firing pin 49 is quickly pushed forward into the shotgun shell 56, similar to the mechanical firing pin of a gun. To reload gas container 24 and shotgun shell 56, the housing 18 is screwed off the knife blade assembly 50 to expose the shotgun shell. End cap 14 is unscrewed to replace the gas container 24.

As an alterative to shotgun blank shell 56, a mechanical device such as a hydraulic or air cylinder, or straight compressed gas or air, can be used to drive the knife piston/rod assembly into container 24. In this case, an ignition source, such as a sparking device, is required to ignite the gas when container 24 is ruptured.

The device of the present invention is not designed to be a weapon or destructive device and thus provides a simplified and economical device for generating an audible and visual fireball effect that provides a safe, consistent and predictable sized fireball effect for use within the entertainment industry and as a training aid for law enforcement, fire departments and other governmental agencies, the military and companies engaged in the business of security training.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A device for generating a fireball effect comprising:

a first cylindrical housing having an outer surface with a first pattern of openings formed therein, first and second threaded end cap portions and a hollow interior portion, said second threaded cap portion having an opening formed therein;

a container having ignitable pressurized gas stored therein and positioned within the hollow interior portion; and having top and bottom portions;

a movable member having first and second ends positioned adjacent said bottom end of said container, said first end of said movable member being capable of puncturing said bottom portion of said container when said member first end impacts said bottom portion with a predetermined force;

a solenoid having a piston type member, said piston type member functioning as a firing pin; and a shotgun shell having a primer cap fired by said firing pin when said solenoid is activated, and having a first end operatively coupled to said solenoid and having a second end positioned adjacent said second end of said movable member, activation of said solenoid causing gasses from said shotgun shell to act on said first end of said movable member to propel said second end in a manner to puncture said bottom portion of said container, said ignitable pressurized gas in said container being released into said interior portion and mixing with gas from said fired shell member to produce a burning gas mixture, said gas mixture exiting said first cylindrical housing through said first pattern of openings to produce a visible fireball.

2. The device of claim 1 wherein said first end of said movable member comprises a knife blade.

3. The device of claim 1 wherein a plurality of rib members project from the outer surface of said first and second threaded cap members.

4. The device of claim 1 further including a second pattern of openings formed along the outer surface of said housing, locating fasteners being positioned with said second pattern of openings to align said container within said housing interior portion.

5. The device of claim 1 wherein said solenoid and said shotgun shell are operatively positioned within a solenoid housing assembly, said solenoid piston functioning as a firing pin for said shell member when said solenoid is activated.

6. The device of claim 1 wherein said movable member is positioned within a second cylindrical housing having first and second ends, said second cylindrical housing positioned within said interior portion of said first cylindrical housing, the surface of said second cylindrical housing having openings positioned adjacent said second end of said second cylindrical housing openings to allow gas generated by said shotgun shell to escape to the interior portion of said first cylindrical housing.

7. The device of claim 1 wherein said ignitable pressured gas comprises liquid propane.

* * * * *